US005847700A

United States Patent [19]

Hannah

[11] Patent Number: 5,847,700

[45] Date of Patent: Dec. 8, 1998

[54] INTEGRATED APPARATUS FOR DISPLAYING A PLURALITY OF MODES OF COLOR INFORMATION ON A COMPUTER OUTPUT DISPLAY

[75] Inventor: Marc R. Hannah, Mountain View, Calif.

[73] Assignee: Silicon Graphics, Inc., Mountain View, Calif.

[21] Appl. No.: 105,102

[22] Filed: Aug. 10, 1993

Related U.S. Application Data

[63] Continuation of Ser. No. 715,550, Jun. 14, 1991, abandoned.

[51] Int. Cl.[6] ..... G09G 5/06

[52] U.S. Cl. ..... 345/199; 345/511

[58] Field of Search ..... 340/701, 703, 340/723, 798, 799; 358/32; 345/153, 154, 186, 199, 196, 197, 150, 123, 511, 509, 515, 516, 508, 213; 395/131

[56] References Cited

U.S. PATENT DOCUMENTS

| | | | |
|---|---|---|---|
| 4,642,794 | 2/1987 | Lavelle et al. | 345/123 |
| 4,737,921 | 4/1988 | Goldwasser et al. | 340/723 X |
| 4,751,446 | 6/1988 | Pineda et al. | 345/199 |
| 4,752,893 | 6/1988 | Guttag et al. | 364/518 |
| 4,769,632 | 9/1988 | Work et al. | 345/199 |
| 4,799,053 | 1/1989 | Van Aken et al. | 340/799 X |
| 4,808,989 | 2/1989 | Tabata et al. | 340/703 |
| 4,823,120 | 4/1989 | Thompson et al. | 340/703 |
| 4,825,390 | 4/1989 | Van Aken et al. | 364/526 |
| 4,843,380 | 6/1989 | Oakley | 340/728 X |
| 4,907,086 | 3/1990 | Truong | 358/183 |
| 4,952,917 | 8/1990 | Yabuuchi | 345/199 |
| 5,038,300 | 8/1991 | Seiler et al. | 364/521 |
| 5,065,343 | 11/1991 | Inoue | 340/798 X |
| 5,086,295 | 2/1992 | Boettcher et al. | 340/701 |
| 5,091,717 | 2/1992 | Carrie et al. | 340/703 |
| 5,196,834 | 3/1993 | Edelson | 345/199 |
| 5,400,057 | 3/1995 | Yin | 345/199 |
| 5,488,393 | 1/1996 | Wood et al. | 345/213 |

FOREIGN PATENT DOCUMENTS

| | | |
|---|---|---|
| 0170816 | 6/1985 | European Pat. Off. . |
| 2137857 | 4/1981 | United Kingdom . |
| 2167926 | 11/1984 | United Kingdom . |
| 2218881 | 4/1989 | United Kingdom . |

OTHER PUBLICATIONS

Raster Graphics Handbook, Second Edition, Conrac Division/Conrac Corporation, 5pp., 1985.

*Primary Examiner*—Steven J. Saras
*Assistant Examiner*—Paul A. Bell
*Attorney, Agent, or Firm*—Blakely, Sokoloff, Taylor & Zafman

[57] ABSTRACT

A circuit for translating pixel data to be displayed on the output display of a computer system including a plurality of color index maps for providing a first set of digital values of shades to produce a final color on an output display in response to color index values; and a plurality of gamma correction maps for providing a second set of digital values of shades to produce a final color on an output display in response to the first set of digital values of shades.

21 Claims, 5 Drawing Sheets

INTEGRATED APPARATUS FOR DISPLAYING A PLURALITY OF MODES OF COLOR INFORMATION ON A COMPUTER OUTPUT DISPLAY

This is a continuation of application Ser. No. 07/715,550, filed Jun. 14, 1991, now abandoned.

BACKGROUND OF THE INVENTION

1. Field Of The Invention

This invention relates to output display systems and, more particularly, to integrated apparatus for providing color pixel data on an output display.

2. History Of The Prior Art

A typical computer system generates data which is displayed on an output display. This output display is typically a cathode ray tube which produces a number of full screen images one after another so rapidly that to the eye of the viewer the screen appears to display constant motion when a program being displayed produces such motion. In order to produce the individual images (frames) which are displayed one after another, data may be written into a frame buffer. The frame buffer stores information about each position on the display which can be illuminated (each pixel) to produce the full screen image. For example, a display may be capable of displaying pixels in approximately one thousand horizontal rows each having approximately one thousand pixels. All of this information in each frame is written to the frame buffer before it is scanned to the display.

When data describing an entire picture exists in the frame buffer, the frame may be transferred to the display.

Typically, data is transferred from the frame buffer to the display pixel by pixel and line by line beginning at the upper left hand corner of the display and proceeding horizontally from left to right, line by line, downward to the lower right hand corner of the display. In order for the picture to appear continuous on the output display, the successive frames in the frame buffer must be constantly scanned to the output display at a rate of thirty frames per second or more.

Data may be stored for the individual pixels which are to be presented in a number of forms. In the simplest form, a pixel presented on the display may be one color or another, typically white or black. Since only two conditions are possible, this form of display uses only a single bit of data to indicate one color or the other of the pixel data. Pixel data may also be stored in a grayscale representation which presents a number of shades of gray running from white to black. In a grayscale representation, a number of bits is used to represent each pixel. The number of bits must be sufficient to provide the required number of shades; for example, thirty-two shades may be represented by five bits.

Systems presenting color displays may utilize eight bits, twelve bits, twenty-four bits, or some other number to represent the color information in each pixel. However, there are basically two accepted methods of presenting color on an output display. In the first the pixels available are divided into three groups each of which represents a shade of red, green, or blue. For example, when twenty-four bits of data are used, the system typically uses eight of these bits to represent a shade of red, eight for a shade of green, and eight for a shade of blue. Each of these shades may run from clear to fully saturated. The three red, green, and blue shade values are combined in a manner well known to those skilled in the art to produce the final color. Of course, color systems may use a lesser number of bits to represent each shade and have a lesser number of shades of each color.

Alternatively, a color system may be based on color indexing. With a color indexing system, the bits allocated to define a pixel are used as a code to find a specific color in a color lookup table (color index map). Such a system, called a color indexing system, allows a lesser number of specific colors to be selected for use from the very large number of twenty-four bit colors, for example. One especially desirable feature of a color indexing system is that by simply changing the color values stored in the color map, different colors may be provided for different programs.

However, changing the colors in a color index map requires that the map be written to. This should be accomplished so that the writing does not interfere with the presentation of information on the output display. In many systems the method used has been relatively slow and not able to produce optimal results especially where the color index changes frequently. Often this means that interference with the display has simply been accepted.

In general, twenty-four bit color is more realistic and more desirable. However, it requires a large amount of frame buffer memory. Consequently, many more application programs are written for color index systems. To use these programs, a computer system designed for twenty-four bit color must also provide for translating color index values. Typically, if a computer system has been able to operate with programs utilizing different types of color display schemes, such systems did so by adding hardware for each different scheme as a separate circuit arrangement. Such arrangements tended to be very complicated because of the necessity of handling pixels coded in different formats within the same frame buffer. Typically, these circuit elements appeared as parts of separate integrated circuits in which individual functions were often duplicated. Such duplication increases the cost of computer systems, tends to make the systems operate more slowly, and is generally detrimental to overall system operation.

One of the desirable features of recent color systems has been the ability to present video information in real time in a window on the output display. Like systems utilizing different types of color systems, the hardware for presenting video in a window on an output display usually appears as an individual integrated circuit or circuits which are added to a system which has already been designed. This method of adding a feature also causes a proliferation of circuit elements and is typically wasteful of resources.

SUMMARY OF THE INVENTION

It is, therefore, an object of the present invention to provide integrated apparatus for allowing different color formats to be presented on an output display.

It is another object of the present invention to provide an integrated arrangement to allow color maps to be changed without interfering with the display of data on an output display.

It is another object of the present invention to provide an integrated arrangement for controlling the presentation of pixels on an output display which arrangement may be used to provide video signals on the output display and to furnish signals from a frame buffer to be used for separate video display purposes.

These and other objects of the present invention are realized in a circuit for translating pixel data to be displayed on an output display of a computer system including a plurality of color index maps for providing a first set of digital values of shades in response to color index values furnished from a frame buffer; and a plurality of gamma correction maps for providing a second set of digital values of shades in response to the first set of digital values of shades.

These and other objects and features of the invention will be better understood by reference to the detailed description which follows taken together with the drawings in which like elements are referred to by like designations throughout the several views.

NOTATION AND NOMENCLATURE

Some portions of the detailed descriptions which follow are presented in terms of symbolic representations of operations on data bits within a computer memory. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to a method and apparatus for operating a computer in processing electrical or other (e.g. mechanical, chemical) physical signals to generate other desired physical signals.

DETAILED DESCRIPTION OF THE INVENTION

Figure 1:
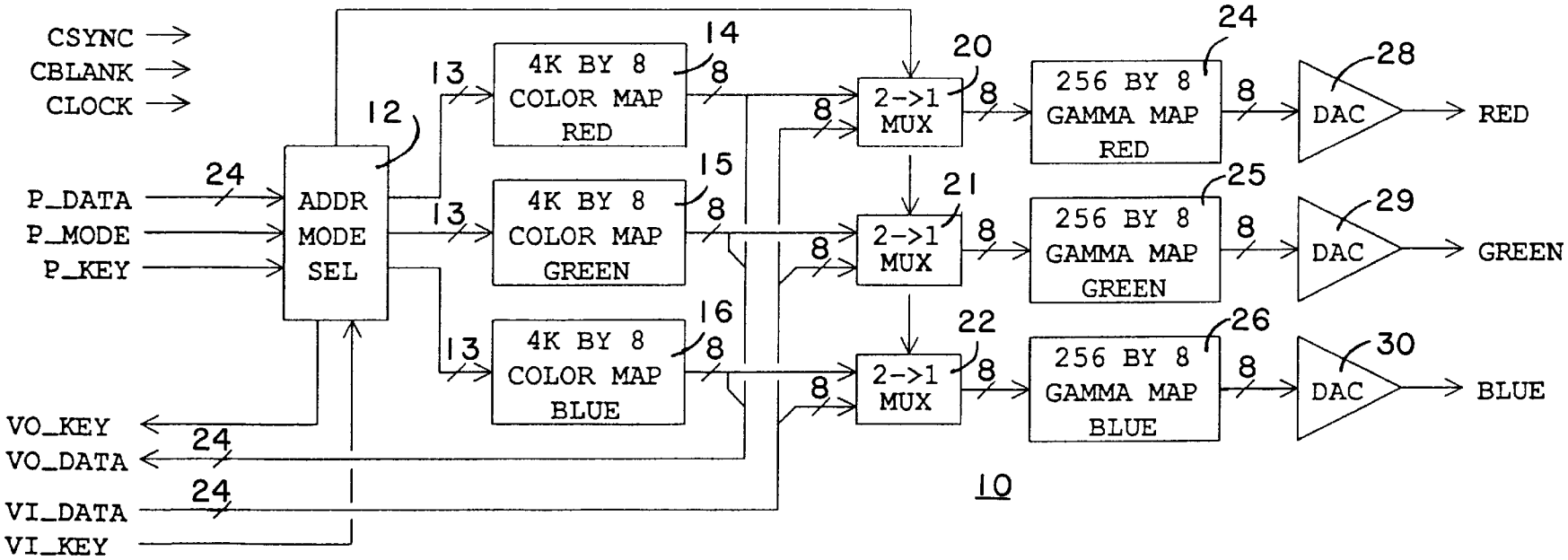
FIG. 1 is a functional block diagram of circuitry for providing pixel data to an output display in accordance with the present invention.

Referring now to FIG. 1, there is illustrated a functional block diagram of output display circuitry 10 designed in accordance with the present invention. The circuitry 10 illustrated in FIG. 1 is utilized for the transfer of pixel data to the output display. The circuitry 10 includes an address mode selector circuit 12. The address mode selector circuit 12 is used in the present invention to control the translation of the different modes of color which are to be presented, to allow video signals to be overlaid on an output display, and to allow video signals to be derived from the data stored in a frame buffer (not shown in the figure) for use by peripheral equipment.

The circuit 12 receives pixel data (P_DATA) from a frame buffer. This data may be in one of two different color modes. In the preferred embodiment, these modes are a twenty-four bit color mode and a twelve bit indexed color mode. In the twenty-four bit color mode, the data stored in the frame buffer defining each pixel represents the color by three individual eight bit values. Each of these values defines a shade of red, green, or blue which is to be combined with the other of the three values to produce a final pixel color. The eight bits defining red indicate the amount of red in the final color from none to fully saturated; the eight bits representing green and blue represent those colors in a similar manner. The twenty-four bit color mode allows approximately sixteen million individual colors to be represented and presented on the output display. However, the use of twenty-four bit color requires that at least the full twenty-four bits be stored in the frame buffer for each pixel to be displayed on the output display. Frame buffer memory is typically two ported video random access memory which is quite expensive.

The indexed color mode, on the other hand, offers a substantially smaller number of colors selected from the same total spectrum of approximately sixteen million colors only twelve bits of data are utilized in the preferred embodiment to define a color so that only 4096 individual colors may be selected at any one time. In effect, the index is a code used to select a particular one of the total number of colors available in the twenty-four bit color system. However, the value coded by the twelve bits must be decoded to provide the correct twenty-four bit color to be displayed on the output display. The use of an indexed color mode allows a much smaller number of bits of data to be stored and thus requires less frame buffer space. Consequently, less expensive systems tend to use color indexing; and many programs are written for this color format.

For a twenty-four bit color system to run programs using indexed color, it must be able to decode the color index values. In order to accomplish this decoding of the colors represented by the color index values, the present system transfers the color index value furnished by the frame buffer for any pixel to each of three color map circuits 14, 15, and 16. Presuming that the mode of operation indicates that the data is color index data, each of the three color map circuits 14, 15, and 16 looks up the value stored at the position indicated by the coded index and provides an output signal of eight bits. Each eight bit output signal defines one of the three shade representations (red/green/blue) of a twenty-four bit color. Thus, for example, the color map circuit 14 receives the index value and looks up that value to provide an eight bit output indicating the value of the red shade in the final twenty-four bit color. The circuits 15 and 16 each operate in a similar manner to provide output data indicating the shades of green and blue in the final color for each pixel for which an index value is furnished.

In order to be able to determine that the index values stored in the frame buffer and furnished to the circuit 12 are color index values rather than twenty-four bit color values, a pixel mode signal P_MODE is provided to the circuit 12 along with each pixel value. The pixel mode signal may be a single bit with one condition indicating one color format and the other condition indicating the other format. In this manner, pixel values coded in both twenty-four bit color format and twelve bit color index format may be stored simultaneously in the frame buffer. Since different application programs may function in either of these different color modes, this offers a substantial advantage over other systems.

In the preferred embodiment of the invention, the color mode signal presented to the circuit 12 causes the circuit 12 to transfer the lower twelve bits which are the color index values to each of the circuits 14, 15, and 16 to be translated by the color tables along with a single color mode bit in the most significant bit position. By looking at the mode bit, the circuits 14, 15, and 16 recognize these values as color index values. In the preferred embodiment of the invention, each of the color index map circuits 14, 15, and 16 include four kilobytes of memory so that it is able to store just over four thousand individual shades of a color.

On the other hand, if the information is twenty-four bit color data, the shade values are sent to the same circuits 14–16; but no translation is necessary or accomplished on the values. The three groups of eight bits indicating the shades of red, green, and blue are each concatenated by the circuit 12 with five high order bits. The most significant of these bits is a mode bit which indicates that the data is twenty-four bit color data. The four other high order bits simply fill out the twelve bits used to address the color index maps and may be conveniently dropped by the circuits 14, 15, and 16 when the mode bit indicates that the data transferred is not color index data and is not to be translated by the color tables. Consequently, the eight lower order bits defining each shade of the twenty-four bit color pixel are simply transferred directly through the circuits 14, 15, and 16 without change. This arrangement allows the two different color formats to both be processed through the color index maps thereby reducing circuit complexity and operational time. This greatly facilitates the operation of the output display system and allows a very compact arrangement without redundant circuitry.

From the circuits 14, 15, and 16, the eight bits of data for each color shade (whether generated by the color index maps or transferred directly from the frame buffer) are transferred by one of three multiplexors 20–22 to one of three gamma correction maps 24–26. Each of these maps provides color correction so that the color actually presented on the output display is a relatively accurate representation of the color desired. Gamma color correction is necessary because of the different responses of the phosphors utilized in various output displays. Essentially, although there is a direct relationship between the display signal and the voltage applied to the display monitor, this is not true of the output of the screen phosphors. Consequently, the linear eight bit color values which have been utilized within the computer system need to be translated to eight bit values which will cause the screen phosphors to more closely approximate the color desired. A discussion in detail of gamma color correction is provided beginning at page 215 of "Raster Graphics Handbook," 2d edition, copyright 1985 by the Conrac Corporation, published by Van Nostrand Reinhold.

The eight bit binary output values provided by the gamma correction maps 24–26 are transferred to three individual digital-to-analog converter circuits 28–30. These circuit 28–30 provide the three analog signals used for driving an analog color display. The details of these circuits are well known to those skilled in the art and are therefore not) discussed in this specification.

In order to allow the overlay of video information already encoded in twenty-four bit color format on a picture presented on an output display, an external source of video input data is illustrated connected to provide three eight bit color shades to each of the multiplexors 20–22. A video input signal VI_KEY to the circuit 12 may be used to select whether the multiplexors 20–22 transfer the video information or the data from the frame buffer to the output display. Typically, if there is video present, the video will be overlaid on the graphics data held in the frame buffer. The video input signal from the video source tells whether the video is present. A pixel key signal P_KEY is provided by the frame buffer to instruct whether the graphics information or the video information has control if there are video signals present. Typically, the information from which the P_KEY signal is derived is contained with the pixel data stored in the frame buffer.

In addition, eight bit red, green, and blue color data may be selected for transfer from the output of each of the color maps 14–16 for use by other circuitry such as video recording circuitry. In such a case, signals VO_KEY indicating the use to be made of the data are transferred from the circuit 12 to the circuitry which is to be the recipient of the data to be used for video. This data may be utilized by a video cassette recorder, for example, to record the graphics data stored in the frame buffer.

One substantial problem encountered in computer systems using color indexing is that certain application programs such as animation programs frequently change the array of colors provided. Each such change requires that different shade values be stored in the color index maps so that they may be decoded by the color index values. Other situations also require the rapid change of color used for display. For example, when a number of individual application programs are multitasking and their outputs are displayed in a plurality of windows on the screen of an output display, each of the applications may allow the selection of an array of different colors. If each program uses a different array of colors, different values must be utilized for each in the color maps. If the color index maps of all of the windows do not fit into the memory space provided by the color maps, large sections of the color maps must frequently be reloaded as different application windows are activated.

Consequently, the values used in the color maps may be rapidly changing during a display. In order to cause this to happen, it is necessary for some controlling circuitry such as a central processing unit to change the values stored in the color maps to suit the colors desired by the application programs.

In a typical computer system, the controlling circuit (e.g., the central processing unit) simply writes to the color maps to change the values stored whenever a change is desired. However, since the color maps are handling the lookup of different color values for color indexing while data is being transferred to the display, it is desirable to keep the changing of values stored in the color maps from interfering with the data being displayed. This can be accomplished if two ported memory is used for the color maps. By using such two ported memory, the changes to the color maps may be written to the display while data is being furnished to the display. However, two ported memory is quite expensive, and it is much more economical to utilize conventional single ported memory for the color tables. Using single ported memory means that while the colors are being changed in the color maps, the maps cannot be used to furnish data for display. In conventional systems, the display will suffer. It is, of course, possible to change the color maps on the fly and let the interference occur as a tolerable side effect.

Another way to handle the problem is to modify the color tables while the display scan process is in the vertical retrace period of operation and data is not being directed to the display. This works well where the values stored in the maps are changed only infrequently. This might be the case, for example, where only a single application program is running which does not change color values frequently and the system changes to a new program which uses different color values. However, the aforementioned system is unable to correctly handle changes to the color maps which occur within the period in which a single frame is scanned to the display.

The present invention provides a solution to the problem where color values need to be changed very often and very rapidly. The present invention utilizes the horizontal retrace periods available after the display of each row on the display to accomplish any change of the color tables which may be necessary. In prior art circuits, this time has been too small to accomplish write operations which might typically take five hundred nanoseconds for each address at which a shade is to be changed. However, in order to utilize as much of the time during each such period as is available, the system provides a first-in first-out buffer circuit (FIFO) to accumulate the data to be written to change the color index maps. Then, when the horizontal retrace period occurs and the data output from the color index maps has ceased for the moment, the data in the FIFO may be written to the color index maps to make the appropriate changes.

Figure 2:
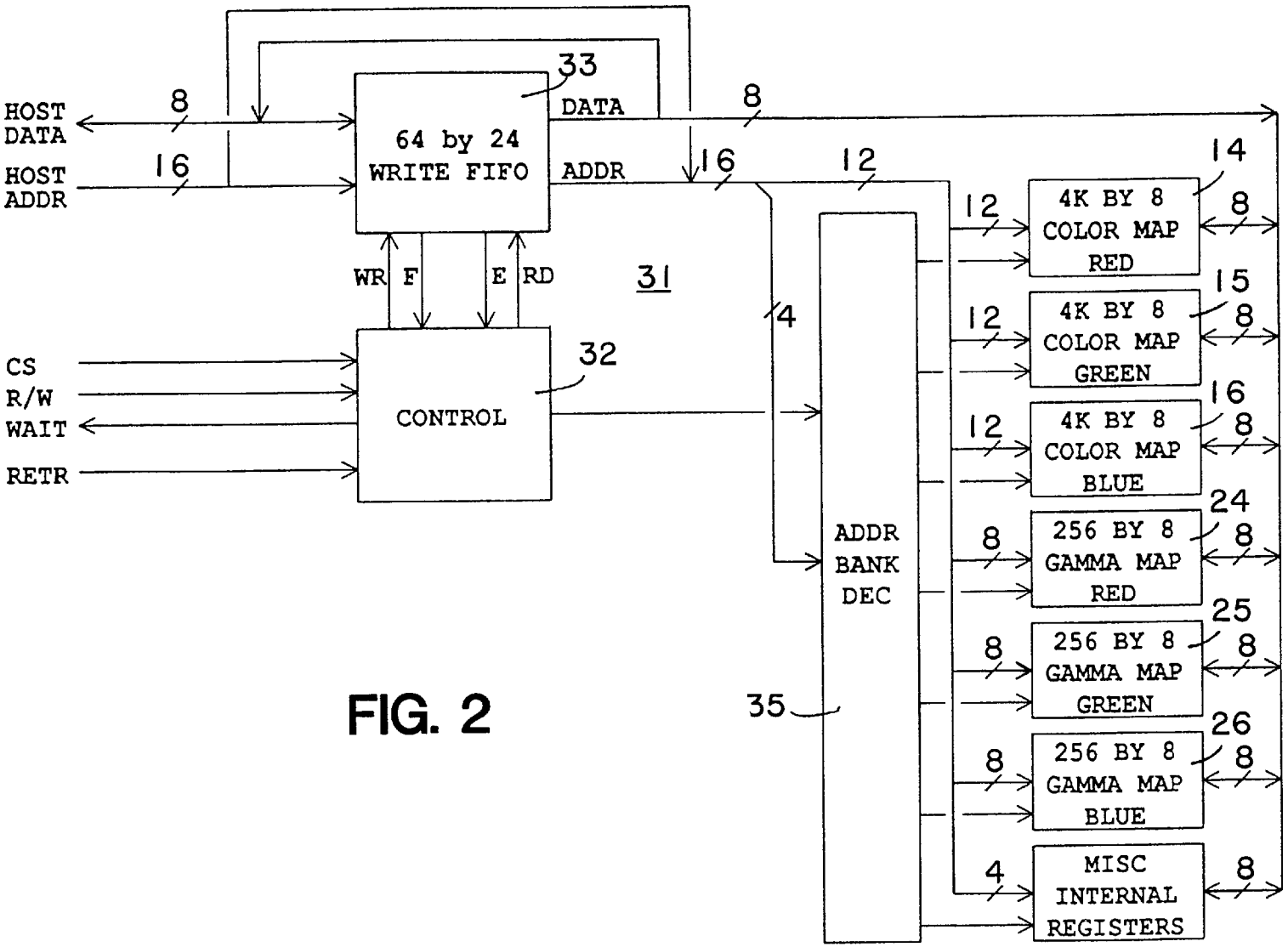
FIG. 2 is a block diagram of circuitry for writing data to the color maps of output display circuitry in accordance with the present invention.

In order to accomplish this operation, the circuit 31 shown in block diagram in FIG. 2 is utilized. Circuit 31 includes a control circuit 32 which receives control signals for controlling the operation by which the color maps are changed. The circuit 32 controls a write FIFO 33 in which data to be written to the color maps and address information for that data is stored by a host such as a central processing unit (not shown in the figure). The control circuit 32 receives a read or write instruction and directs the FIFO in accordance therewith to accomplish the particular operation requested. Typically, the color index maps are not read except during testing operations. Consequently, the read operation is not normally one which need be interfaced with the scanning of data to the display. It is possible, however, to store read operations in the FIFO and execute those operations during a retrace period once the write operations have been completed and the FIFO cleared.

In the usual case, the operation to be accomplished is a write of a value to one of the color index maps 14–16. In such a case, the typical operation when the FIFO is not full commences with the host writing data and an address to the FIFO 33. This information is stored in a queue in the FIFO 33 until the receipt of a signal (Retrace) from the scan control circuitry (not shown in the figure) signalling that a horizontal or vertical blanking period has begun. At this point, a circuit 35 reads the first piece of data in the FIFO queue and writes that first piece of data into one of the color maps at the address stored with the data. The reading continues through the interval allotted for the horizontal (or vertical) retrace as indicated by the receipt of the Retrace signal from the scan control circuitry. In the preferred embodiment of the invention, the time required to write each piece of data from the FIFO is approximately nine nanoseconds. Thus, a very large number of pieces of data may be written during the horizontal blanking period (typically approximately four microseconds). Normally the size of the FIFO is limited by the time a host write to the FIFO requires. A host access in the preferred embodiment requires approximately five hundred nanoseconds so approximately twenty-two individual pieces of data may be written to the FIFO during the eleven microseconds of an active horizontal scan.

By utilizing the horizontal blanking period to accomplish changes in the values in the color index maps, the present invention allows changes in color to be accomplished during the period in which a single frame is being scanned to the display. This is to be contrasted with prior art arrangements using single ported memory for color index maps in which changes could only be effected during the vertical blanking period, or in which dual ported memory was used.

Figure 5A:
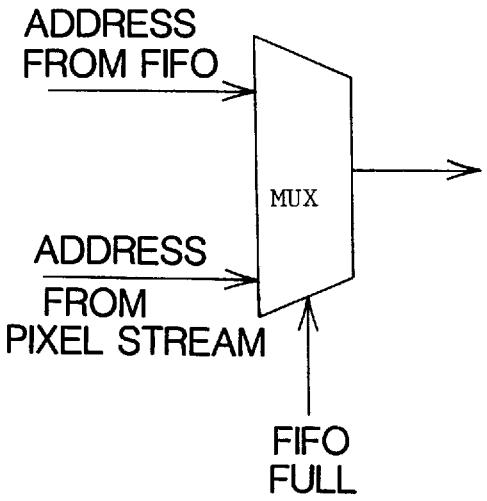
FIGS. 5A and 5B are block diagrams of multiplex or circuits wherein FIG. 5A provides an address to the color tables when ever the FIFO is full so no data is lost and FIG. 5B is a circuit for switching the color map memory between display mode and host access mode.

The FIFO illustrated in the figure when used in a preferred embodiment provides memory for sixty-four individual pieces of eight bit data along with sixteen bit addresses. Consequently, it is unlikely that the FIFO will be filled. However, should the FIFO be filled, the control circuit 32 provides for writing to the color tables and disturbing the display so that no data will be lost by the inability of the circuitry to provide sufficient storage space. To accomplish this, a multiplexor (see FIG. 5*a*) may be provided in the arrangement to provide the address of memory from either the input pixel or from the write FIFO circuit, depending on the condition of the FIFO.

As may be seen in FIG. 2, an address bank decoding circuit 35 is provided to accomplish the addressing of the various color maps. As may also be seen, the three gamma correction maps 24–26 are also connected so that they may be accessed by the host and the values in those gamma correction color maps may be corrected by use of the FIFO circuit 33 should this prove desirable.

Figure 5B:
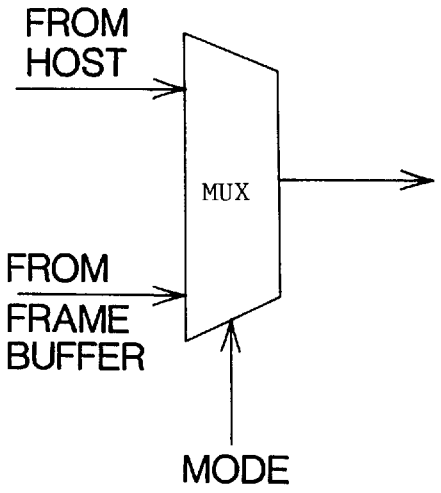

Switching of the color map memory between the display mode in which data is transferred through the color maps to be displayed on an output display and the host access mode in which the values stored in the color maps may be changed is accomplished using a series of two-to-one multiplexors (see FIG. 5*b*) at the address input to each color map. When in display mode, the multiplexors select the color map address from address mode selector 12 for the color maps memories 14, 15, and 16, from multiplexor 20 for map 24, from multiplexor 21 for map 25, and from multiplexor 22 for map 26. When in host access mode, the color map addresses come from the write FIFO address output.

Figure 3:
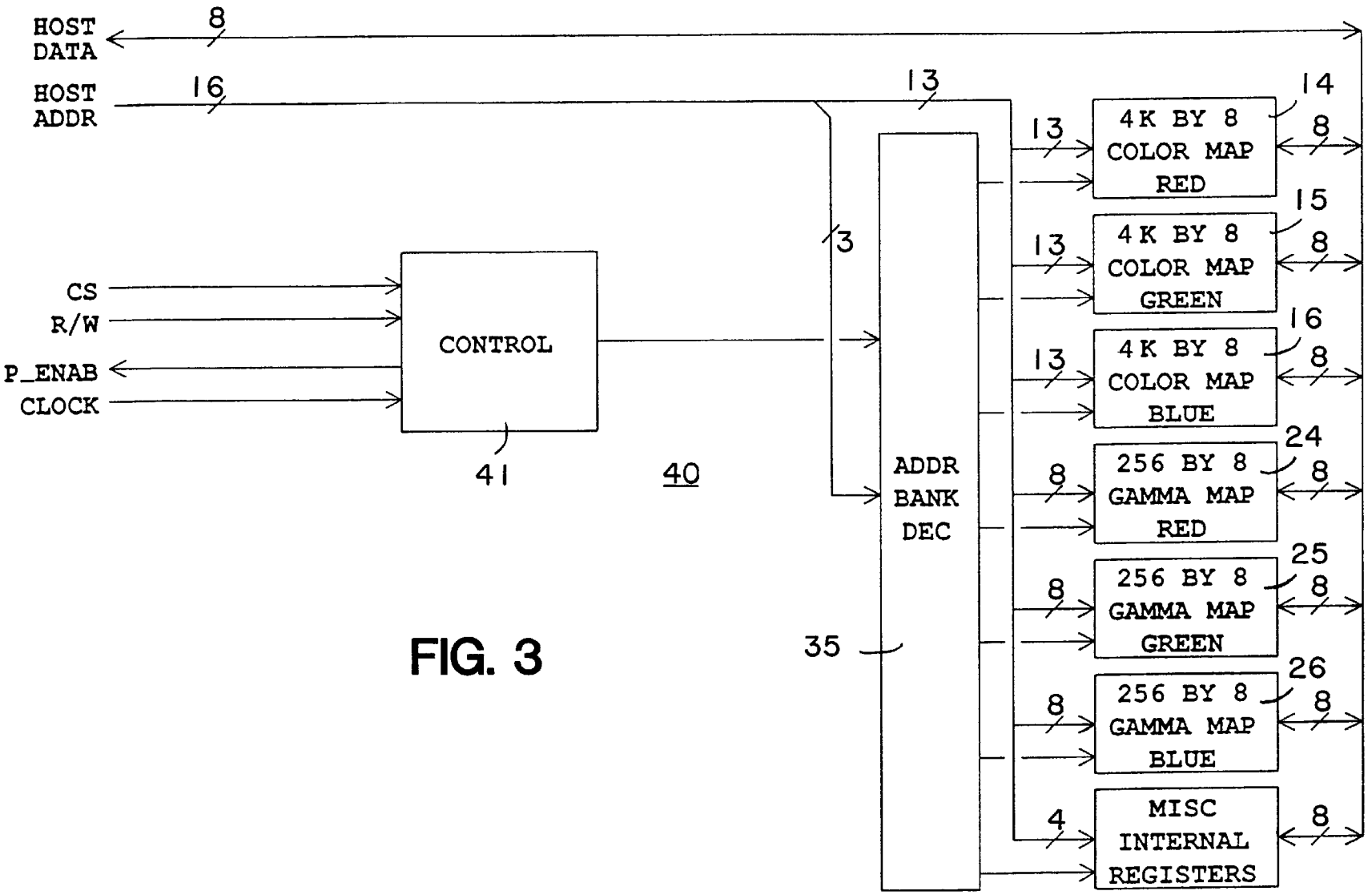
FIG. 3 is a functional block diagram of additional circuitry for providing pixel data to an output display in accordance with the present invention.
Figure 4:
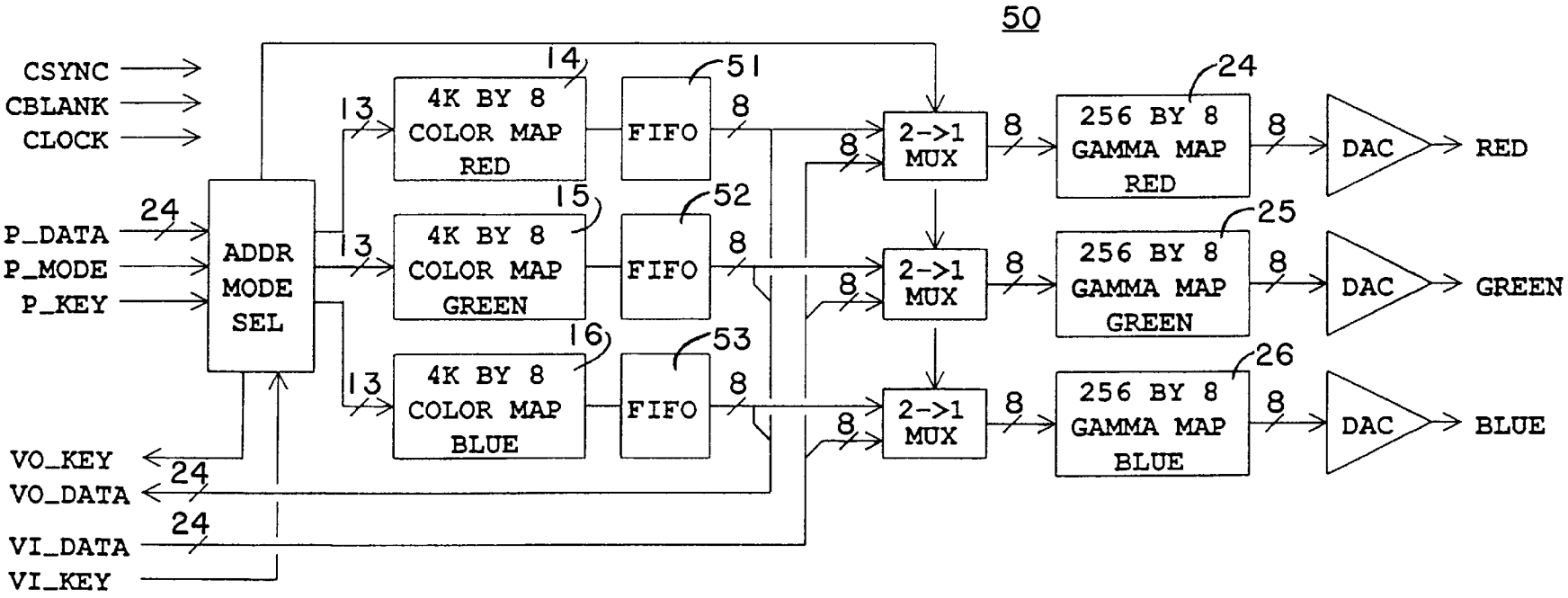
FIG. 4 is a block diagram of additional circuitry for writing data to the color maps of output display circuitry in accordance with the present invention.

A second arrangement by which a host may have access to the color maps of an output display system to change the data stored for color indexing is illustrated in FIGS. 3 and 4. In the arrangement 40 illustrated in FIG. 3, the input write FIFO 33 of FIG. 2 has been removed so that the host data and addresses are furnished directly to the particular color map the contents of which are to be changed. A control circuit 41 is arranged to control this operation. In order to preclude interference with the normal functioning of the look-up processes of the color maps, the arrangement 50 of FIG. 4 is provided. In this arrangement, FIFOs 51, 52, and 53 are arranged at the output of the color index maps (referred to in this figure by the same numbers 14–16 as were used in FIG. 1). Each of the FIFOs 51–53 is used to store the red, green, or blue pixel shade data provided from the associated color maps 14–16 so that a period is available in which the color maps 14–16 can be accessed by the host without disturbing the flow of pixel data to the color display.

Thus, if during the period of the horizontal retrace, pixel values for the next row of data to be scanned to the display are sent to the color maps and clocked into the FIFOs 51–53 so that the FIFOs are full of pixel data when the next horizontal scan line begins, then pixel data to be provided to the display through the gamma maps is available from the FIFOs 51–53. Pixel data from the row initially placed in the FIFOs continues to be written to the FIFOs from the color maps 14–16, and the output pixel data is furnished to the gamma correction maps from the FIFOs unless the host desires to write to the color maps 14–16 to change their values. In such a case, the pixel enable (P_ENAB) signal is deasserted allowing the host to write to the color maps. During this interval, pixel data continues to be available in the FIFOs 51–53 for display. When the host has completed its changes in the color tables, the P_ENAB signal is asserted again so that the pixel data from the frame buffer flows to the color tables and into the FIFOs 51–53.

It is, of course necessary that the FIFOs 51–53 have enough storage to furnish pixels during the period during which the host write to the color maps 14–16 is occurring. In general the length of time available for the host write to occur without interfering with the pixel data is a period equal to the length of the horizontal retrace period. Thus, the FIFOs must be large enough to hold a number of pixels equal to the time during which the color maps might be occupied by host accesses divided by the pixel duration. For example, if the scan of a row on the display takes sixteen microseconds, if the host can request a memory cycle every five hundred nanoseconds, if the pixel duration is nine nanoseconds, and if a host cycle occupies the color maps for eighteen nanoseconds, then the FIFOs would have to store (16,000/500) multiplied by (18/9) pixels. Consequently, the FIFOs 51–53 should in the preferred embodiment provide storage for sixty-four individual pixels.

Although the present invention has been described in terms of a preferred embodiment, it will be appreciated that various modifications and alterations might be made by those skilled in the art without departing from the spirit and scope of the invention. For example, as mentioned, the arrangement suggested for modifying the values in the color indexing maps might be utilized to change the values in the gamma correction maps were such a change desirable. The invention should therefore be measured in terms of the claims which follow.

What is claimed is:

1. An apparatus for providing digital shade values for display on a display device for a data processing system, the apparatus comprising:

a color index map to contain digital shade values, said color index map being configured to translate pixel data received from a frame buffer into one or more of the digital shade values during an active scan period of the display device;

a FIFO buffer coupled to receive updated digital shade values from the data processing system during the active scan period and to transfer the updated digital shade values to said color index map during a retrace interval of the display device; and control circuitry coupled to detect when said FIFO buffer is full of digital shade values and to initiate the writing of digital shade values from said FIFO buffer into said color index map even during the active scan period.

2. The apparatus of claim 1 wherein the retrace interval is a horizontal retrace interval.

3. The apparatus of claim 1 wherein said FIFO buffer is further configured to receive from the data processing system addresses of memory locations within said color index map to which the updated digital shade values are to be transferred.

4. The apparatus of claim 1 wherein digital shade values of a different color are stored in each of a plurality of color index map memories comprised by said color index map.

5. The apparatus of claim 4 wherein each of the plurality of color index map memories is a single port memory.

6. The apparatus of claim 4, wherein red shade values are stored in a first one of the plurality of color index map memories, green shade values are stored in a second one of the plurality of color index map memories, and blue shade values are stored in a third one of the plurality of color index map memories.

7. The apparatus of claim 1 wherein the pixel data received from the frame buffer includes color index data or digital shade values; and said color index map is further configured to output digital shade values received from the frame buffer without translation.

8. The apparatus of claim 7 wherein each pixel datum received from the frame buffer includes a pixel mode bit indicating whether the pixel datum is a color index value or a digital shade value.

9. An apparatus for providing digital shade values for display on a display device for a data processing system, the apparatus comprising:

a color index map to contain digital shade values, said color index map being configured to translate pixel data received from a frame buffer to one or more of the digital shade values during an active scan period of the display device;

a FIFO buffer coupled to said color index map, said FIFO buffer being configured to receive updated digital shade values from the data processing system during the active scan period and to transfer the updated digital shade values to said color index map during a retrace interval of the display device;

a gamma correction map coupled to said color index map and to said FIFO buffer, said gamma correction map being configured to receive digital shade values from said color index map and translate the digital shade values into corrected digital shade values during the active scan period; and wherein said FIFO buffer is further configured to receive updated corrected digital shade values from the data processing system during the active scan period and to transfer the updated corrected digital shade values to said gamma correction map.

10. The apparatus of claim 9 wherein said FIFO buffer is further configured to receive from the data processing system addresses of memory locations within said gamma correction map to which the updated corrected digital shade values are to be transferred.

11. An apparatus for providing digital shade values for display comprising:

a frame buffer to store image data received from a host processor, the image data representing at least a portion of an image;

color index map circuitry to output a sequence of digital shade values indicated by the image data stored in the frame buffer, the color index map circuitry being configured to store in an update operation updated digital shade values received from the host processor; and a FIFO buffer to receive from the color index map circuitry the sequence of digital shade values and to output each digital shade value of the sequence of digital shade values for display at a respective location on a display device during the update operation to prevent display of incorrect digital shade values while updated digital shade values are stored in the color index map circuitry.

12. The apparatus of claim 11 wherein said write circuitry is further configured to receive color map addresses from the host processor, and to write each of the updates of digital shade values to a respective one of the color map addresses in the color index map circuitry.

13. The apparatus of claim 11 wherein the color index map circuitry includes a plurality of color index map memories, and wherein digital shade values of a different color are stored in each of the plurality of color index map memories.

14. The apparatus of claim 13 wherein each of the plurality of color index map memories is a single port memory.

15. The apparatus of claim 13 wherein red shade values are stored in a first one of the plurality of color index map memories, green shade values are stored in a second one of the plurality of color index map memories, and blue shade values are stored in a third one of the plurality of color index map memories.

16. The apparatus of claim 11 further comprising:

gamma correction map circuitry coupled to the FIFO buffer and configured to translate digital shade values output from the FIFO buffer into corrected digital shade values and to output the corrected digital shade values for display on the display device.

17. The apparatus of claim 11 wherein the image data received from the frame buffer includes color index data or digital shade values; and the color index map circuitry is further configured to transfer digital shade values received from the frame buffer to the FIFO buffer without translation by said color index map circuitry.

18. The apparatus of claim 17, wherein the color index map circuitry is responsive to pixel mode bits in the image data received from the frame buffer to determine whether the received image data includes color index data or digital shade values.

19. The apparatus of claim 11 wherein said FIFO buffer is further configured to receive a sequence of digital shade values from said color index map circuitry during a retrace interval.

20. A method for updating a color index map in a display device of a data processing system, the method comprising the steps of:

a FIFO buffer receiving a plurality of digital shade values from the data processing system during an active scan period;

transferring the plurality of digital shade values from the FIFO buffer to the color index map during a retrace interval of the display device;

detecting the FIFO buffer is full; and transferring the plurality of digital shade values to the color index map during the active scan period in response to detecting the FIFO buffer is full.

21. The method of claim 20 further comprising the step of receiving from the data processing system addresses of memory locations within the color index map to which the plurality of digital shade values are to be transferred.

* * * * *